United States Patent [19]

Van Benschoten

[11] 3,979,571

[45] Sept. 7, 1976

[54] BUCKLED SPRING SWITCH MECHANISM WITH LATCHING PUSHBUTTON

[75] Inventor: Peter J. Van Benschoten, Rancho Santa Fe, Calif.

[73] Assignee: Oak Industries Inc., Crystal Lake, Ill.

[22] Filed: Dec. 9, 1974

[21] Appl. No.: 531,038

[52] U.S. Cl. ..... 200/328; 200/276

[51] Int. Cl.[2] ..... H01H 1/20

[58] Field of Search ..... 200/328, 67 DB, 159 R, 200/276, 153 J

[56] References Cited

UNITED STATES PATENTS

| | | | |
|---|---|---|---|
| 3,420,969 | 1/1969 | Edwards et al. | 200/328 |
| 3,863,040 | 1/1975 | Van Benschoten | 200/67 DB |

*Primary Examiner*—Robert K. Schaefer
*Assistant Examiner*—M. Ginsburg
*Attorney, Agent, or Firm*—Kinzer, Plyer, Dorn & McEachran

[57] ABSTRACT

A switching mechanism has at least two terminals partly positioned within a housing and a reciprocal actuator movable within the housing. A coil spring, under endwise buckling pressure, is mounted between spaced portions of one of the terminals, with movement of the actuator causing the coil spring to pivotally move toward and away from another terminal. A slider is positioned in one end of the coil spring and arranged for contact with the actuator to cause pivotal movement of the coil spring. The actuator and slider have cooperating means for latching the actuator in an operated position.

8 Claims, 7 Drawing Figures

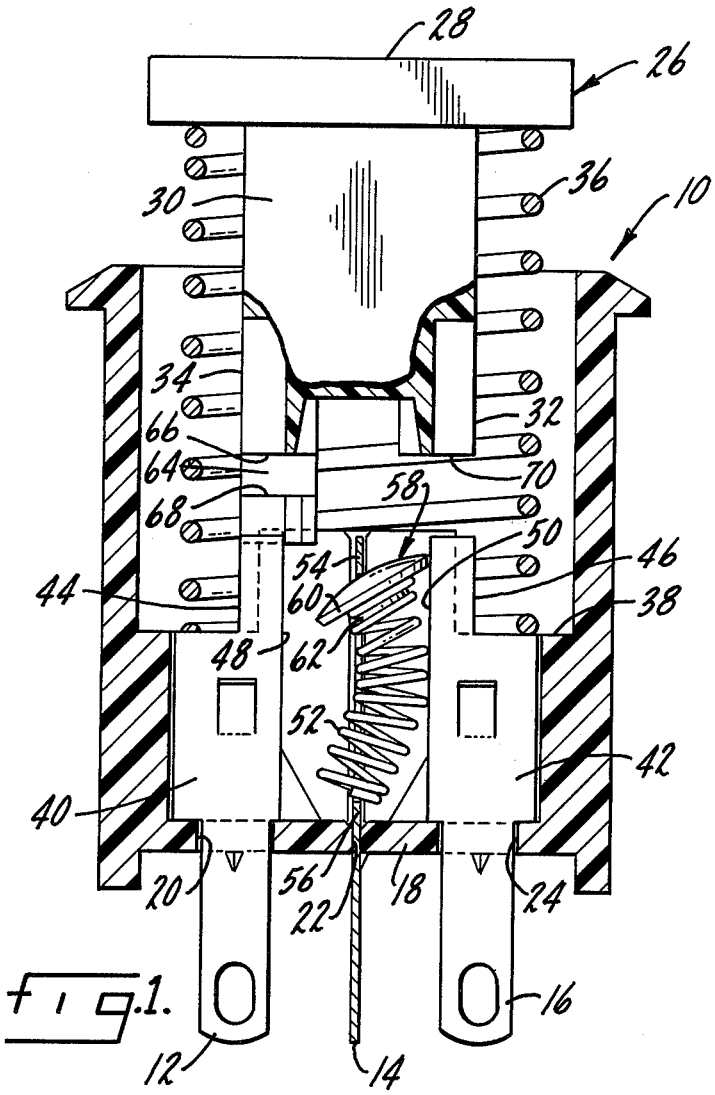
fig. 1.
fig. 2.
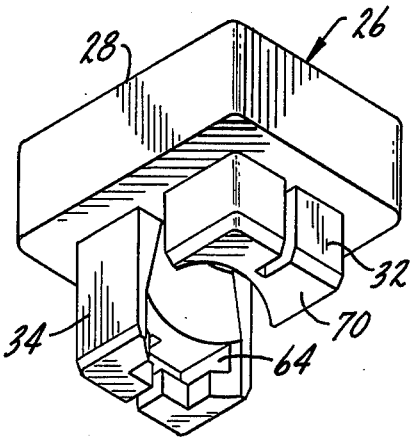
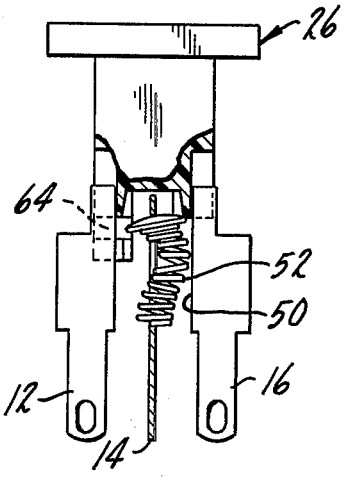
fig. 3a.
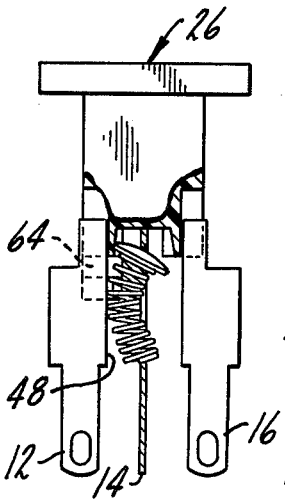
fig. 3b.
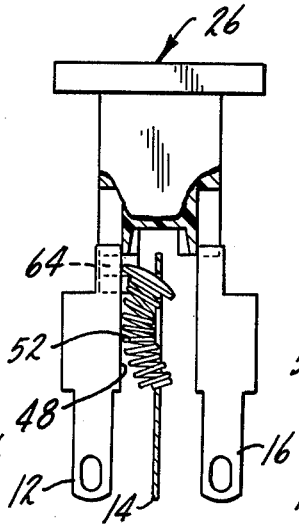
fig. 3c.
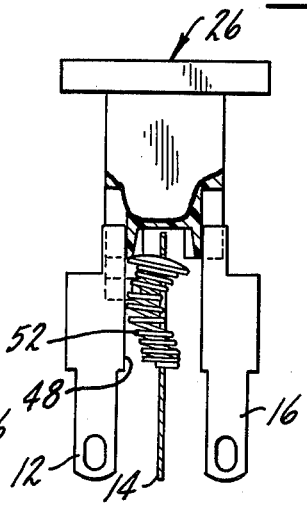
fig. 3d.
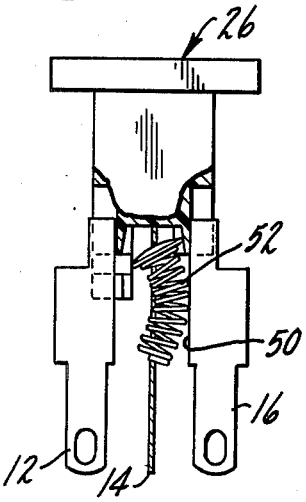
fig. 3e.

BUCKLED SPRING SWITCH MECHANISM WITH LATCHING PUSHBUTTON

SUMMARY OF THE INVENTION

This invention relates to a reciprocal switch mechanism and particularly to such a switch utilizing a buckled coil spring as a portion of the electrical path between terminals and including means for latching the button or actuator in an operated position. Such latching operation is desirable to give the operator a visual indication of the "on" or "off" position of the switch.

One purpose of the invention is a switching mechanism of the type described in which the buckled coil spring mounts a slider, with the slider and actuator having cooperating interlock means.

Another purpose is a switch mechanism in which a latching pushbutton causes pivotal movement of a buckled coil spring.

Other purposes will appear in the ensuing specification, drawings and claims.

BRIEF DESCRIPTION OF THE DRAWINGS

The invention is illustrated diagrammatically in the following drawings wherein:

FIG. 1 is a vertical section through a switching mechanism of the type described, FIG. 2 is a perspective of the actuator, FIGS. 3*a*–3*e* diagrammatically illustrate the positions of the actuator and the buckled coil spring as the switching mechanism is moved through its various positions.

DESCRIPTION OF THE PREFERRED EMBODIMENT

The present invention is specifically directed to an improvement on the switching mechanism shown in copending application Ser. No. 442,479, filed Feb. 14, 1974 now U.S. Pat. No. 3,863,040. In that particular switching mechanism, a buckled coil spring forms the electrical path between terminals. The present invention provides an improvement in the form of a latch or interlock between the actuator and the coil spring slider to hold the actuator in a depressed position when the switch is operated. Although the present invention will be described in connection with a switching mechanism which is unlighted, it should be readily apparent that the structure shown may be easily adapted for either lighted or unlighted pushbutton applications.

A housing is indicated generally at 10 and may take on a number of different exterior configurations. The housing may be square, round or any other shape consistent with the particular application. The housing is generally hollow and may mount three electrical terminals indicated at 12, 14 and 16. Terminal 14 is positioned intermediate terminals 12 and 16. All of the terminals will extend through cooperating openings in the bottom 18 of the housing, said openings being indicated at 20, 22 and 24, respectively.

An actuator is indicated generally at 26 and has an exterior button portion 28 and an interior portion 30, the bottom end of which is formed by a pair of axially-extending projections 32 and 34. A return spring 36 has its upper end seated upon the bottom surface of the button portion 28 of the actuator 26, and generally surrounds the inwardly-extending projection 30 of the actuator. The bottom end of the return spring 36 bottoms upon a ledge 38 formed within the interior of the housing 10.

Terminals 12 and 16 are generally identical and each include electrical contact portions 40 and 42, respectively, which are positioned within the housing 10 and have notches 44 and 46, respectively, to accomodate the return spring 36. The return spring 36 is electrically insulated from terminals 12, 14 and 16. The contact receiving portions 40 and 42 each have a contact receiving edge 48 and 50, respectively, which edges are positioned for engagement and contact by a buckled coil spring 52. The coil spring 52 is mounted between spaced portions 54 and 56 of terminal 14. Details of this construction are shown in the above-mentioned copending application.

The coil spring 52 mounts a slider 58 within its upper coil. The slider 58 has a portion 60 which extends substantially radially beyond the outer diameter of spring 52 and has a portion 62 which is received within the upper coil of the spring to mount the slider in the spring. Spring 52 is normally under endwise pressure from the spaced terminal supports which pivotally mount the spring, such endwise pressure buckling spring 52 and placing intermediate coils thereof into electrical and mechanical contact with terminal edge 50. Thus, terminal 14 and terminal 16 are in electrical contact when the switch is in the off or inoperative position shown in FIG. 1.

Looking particularly at FIG. 2, projection 34 extends a greater axial distance into the housing than projection 32. Projection 34 has an intermediate slot 64 which is defined by upper and lower surfaces 66 and 68, respectively. Upper surface 66 is generally co-extensive with the bottom surface 70 of projection 32. Slot 64 is positioned to interlock or mate with the radially-extending portion 60 of slider 58.

In operation, the switch is initially in the off position of FIG. 1. As the actuator is depressed, projection 32 will contact the right-hand side of the slider, and cause the slider to be moved into the well between the two projections, as shown in FIG. 3*a*. Such downward movement of the actuator, as shown in FIG. 3*a*, will cause the buckled coils of spring 52 to be moved away from contact with terminal 16. Continued downward movement of the actuator will cause the coil spring to buckle about its pivotal supports until it is in contact with terminal 12, as shown in FIG. 3*b*. Note that the slider is positioned within the well and above slot 64. As the button is released, as shown in FIG. 3*c*, portion 60 of the slider will be caught in slot 64, thus holding or latching the pushbutton in the position of FIG. 3*c*. This is not the full inward position of the actuator or pushbutton, but it is inward relative to the off position of the switch. Thus in FIG. 3*c* the switch is in an on position, terminals 12 and 14 are in electrical contact and the button is latched.

When it is desired to return the switch to its original position, the button is moved inwardly, as shown in FIG. 3*d*. The slider moves out of slot 64 and into the well between the two projections. The coil spring will again pivot about its terminal supports and move into contact with terminal 16, as shown in FIG. 3*e*. When the button is released there is nothing to hold the slider within slot 64 and thus the actuator will move to the full out position of FIG. 1.

The switch mechanism operates generally in the manner shown in the above-mentioned copending application in that the actuator causes the buckled coil spring to pivot about its terminal supports between a pair of different terminals to change the electrical paths within the switch. When the buckled coil spring moves from its initial or rest or off position to a second position, the pushbutton or actuator is latched within the housing. The next operation of the pushbutton releases the latch and thus returns the actuator to its original position.

Although the invention has been described in connection with a three-terminal switch, it should be obvious that it may be equally satisfactorily used with a two-terminal switch. In like manner, the invention should not be limited to either a lighted or unlighted pushbutton switching arrangement, nor to a switch having only one set of contacts.

Whereas the preferred form of the invention has been shown and described herein, it should be realized that there may be many modifications, substitutions and alterations thereto.

The embodiments of the invention in which an exclusive property or privilege is claimed are defined as follows:

1. In a switching mechanism, a housing, at least two terminals partly positioned within said housing, an actuator mounted for reciprocal movement within said housing, return spring means positioned within said housing and normally biasing said actuator outwardly of said housing, coil spring means pivotally mounted under endwise buckling pressure between spaced portions of one of said terminals, a slider positioned in one end of said coil spring means and bearing against one of said spaced terminal portions, said slider being positioned for mechanical contact by said actuator for pivotally moving said coil spring means, about said spaced terminal portions, into and out of electrical contact with the other terminal, cooperating means on said slider and actuator for latching said actuator in an inward position when said actuator has caused said coil spring means to be in electrical contact with said other terminal.

2. The structure of claim 1 further characterized in that said slider has a portion thereof extending substantially radially beyond the outer diameter of said coil spring means.

3. The structure of claim 2 further characterized in that said actuator includes a slot positioned for engagement with the radial extension of said slider.

4. The structure of claim 1 further characterized in that said actuator includes a pair of downwardly-extending projections, one of said projections being of greater axial extent than the other, with said greater projection being positioned and arranged to interlock with said slider.

5. The structure of claim 4 further characterized by and including a slot in said greater projection, said slider including a portion extending radially beyond the outer diameter of said coil spring means and positioned to be received by said slot.

6. The structure of claim 4 further characterized in that said slot has inner and outer surfaces, with the outer surface being generally coextensive with the bottom surface of said other projection.

7. The structure of claim 1 further characterized in that there are three terminals, each partly positioned within said housing, endwise pressure applied by said spaced terminal portions causing said coil spring means to be flexed into electrical contact with the third terminal, said actuator pivotally moving said coil spring means, about said spaced terminal portions, from contact with said third terminal, into contact with said other terminal.

8. The structure of claim 7 further characterized in that one terminal is positioned intermediate said other terminal and said third terminal.

* * * * *